United States Patent [19]

Webster

[11] Patent Number: 4,748,690

[45] Date of Patent: Jun. 7, 1988

[54] PROTECTIVE GLOVE FOR USE IN ATHLETICS

[76] Inventor: Charles H. Webster, 3834 Janbrook Rd., Randallstown, Md. 21133

[21] Appl. No.: 33,753

[22] Filed: Apr. 3, 1987

[51] Int. Cl.[4] ..... A41D 13/10

[52] U.S. Cl. ..... 2/19; 2/20; 2/161 A

[58] Field of Search ..... 2/19, 20, 161 A, 161 R, 2/159, 163, 167, 160

[56] References Cited

U.S. PATENT DOCUMENTS

| | | | |
|---|---|---|---|
| 12,996 | 7/1909 | Peach | 2/19 |
| 3,576,036 | 4/1971 | Latina | 2/19 |
| 3,597,765 | 10/1971 | Stanton | 2/161 A X |
| 4,071,913 | 2/1978 | Rector | 2/161 A X |

FOREIGN PATENT DOCUMENTS

| | | | |
|---|---|---|---|
| 2492265 | 4/1982 | France | 2/20 |

*Primary Examiner*—Peter Nerbun

*Attorney, Agent, or Firm*—JoAnne S. Beery

[57] ABSTRACT

The glove of this invention is characterized by protective, non-springy, shock-absorbing cushions which cover each inner finger from its base to, at least, the first joint, and the upper palm finger pads. Two optional cushions may be provided to cover: (1) the palm from the outer edge of the palm extending inward and upward toward the bottom of the upper palm finger pads cushion; and (2) the thumb pad and inner palm below the thumb. The cushions are attached to the glove and are covered by an outer layer of leather. This inner glove helps protect the critical areas of the fingers and palm, affected during catching of the ball, and reduces the incidence of injury, e.g., bone bruises that can occur during long hours of play.

19 Claims, 6 Drawing Sheets

PROTECTIVE GLOVE FOR USE IN ATHLETICS

PATENT DOCUMENTS AND PUBLICATIONS

U.S. Pat. No. 2,736,028—Sternlicht, L. 2/1956
U.S. Pat. No. 4,042,975—Elliott, Jr., et al. 8/1977
U.S. Pat. No. 4,524,464—Primiano, et al. 6/1985
U.S. Pat. No. 4,561,122—Stanley, et al. 12/1985
U.S. Pat. No. 4,617,684—Green, et al. 10/1986
U.S. Pat. No. 4,624,016—Luevano 11/1986

BACKGROUND AND SUMMARY OF THE INVENTION

For years, athletes who engage in sports which require the catching of a small, hard ball with the hand have been plagued by the constant stress that catching the ball places on their palm and fingers. The conventional large baseball or softball glove currently used for catching is not entirely effective in protecting the hand from the stress received when the ball impacts the glove.

The thin, tight fitting glove used by batters is ineffective for use as an inner glove inside the bulkier, larger, outer baseball or softball glove used in the field for catching the ball because it has no padding and is designed solely to increase the batters grip. All purpose gloves have been designed, but, because of the differences in the optimum design characteristics between a batting glove and an inner protective glove for catching, the all purpose gloves fail to encompass the optimum design parameters, including proper location, thickness, and cushion properties, necessary for proper functioning of an inner glove.

Protective palm pads also have been used but these are difficult to maintain in the proper location and inhibit hand flexibility within the glove because of the excess padding in the crease areas of the palm.

Although conventional baseball or softball gloves are padded, the padding in these large gloves is either insufficient or ineffective much before the glove reaches its maximum utility. In order to eliminate the sting which the player's hand is subjected to when the padding is insufficient or ineffective, the player often will remove his index finger from the glove through an aperature located across the back of the hand. In an effort to overcome the undesirable consequences which attend the use of the glove in this manner, and increase the protection of the player's hand, without decreasing the player's ability to control the glove, attempts have been made to protect this part of the player's hand, but without success.

Existing all purpose and batter's tight-fitting gloves, and protective pads, when used in conjunction with the larger mitts are deficient in that these gloves and pads: are too bulky, thereby inhibiting control; do not protect the critical areas of the hand which receive the stress of catching the ball; do not remain in the proper position; and/or have elastic, shock absorbing cushions which propelling the ball away from the hand on impact thereby working against the proper functioning of the outer mitt and hand.

This invention is an improved protective inner athletic glove designed for wear inside a larger baseball or softball glove. Unlike other gloves designed in the past, the non-springy, shock absorbing cushions of this inner glove enhance the utilization of the outer glove because the cushions act in concert with the outer glove permitting mobility of the hand, with protection in critical areas, without propelling the ball away from the hand on impact as usually is experienced with padding exhibiting inherent elastic characteristics.

It is an object of this invention, therefore, to provide a protective inner athletic glove to be used with a larger, outer baseball or softball glove for catching small, hard balls during play.

Another object of this invention is to provide a protective inner athletic glove made of skin tight soft leather for flexibility and comfort.

Yet another object of this invention is to provide a protective inner athletic glove with sufficient non-springy cushion in critical areas to protect the hand on impact thereby reducing the incidence of injury.

It is another object of this invention, therefore, to provide a tight fitting protective inner athletic glove with non-springy cushions to enhance the catching characteristics of the outer baseball or softball glove.

A further object of this invention to provide a tight fitting protective inner athletic glove for use inside a larger glove which permits, and does not interfere with, the proper functioning of the outer baseball or softball glove and hand.

Another object of this invention is to provide a unique glove which increases proficiency and confidence of the player during defensive play of baseball and softball.

Still another object of this invention is to extend the useful life of the large, outer baseball or softball glove by providing for continued use after the padding in the baseball or softball glove has become worn and ineffective.

Further objects and advantages of this invention will become more apparent in light of the following drawings and description of the preferred embodiment of the invention.

DESCRIPTION OF THE PREFERRED EMBODIMENTS OF THE INVENTION

Figure 1:
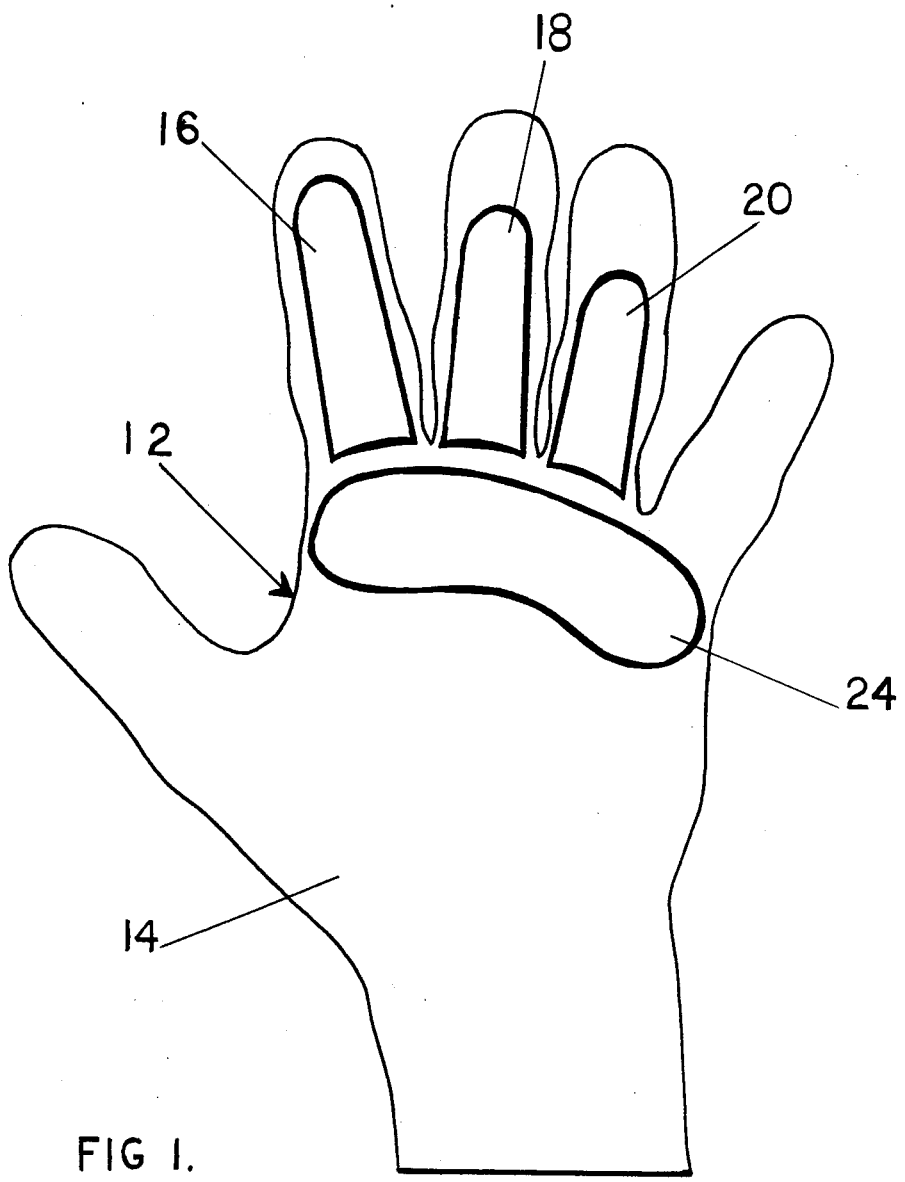
FIG. 1 is an inner hand view of the embodiment of the left hand protective inner athletic glove showing one configuration for the glove cushions.
Figure 2:
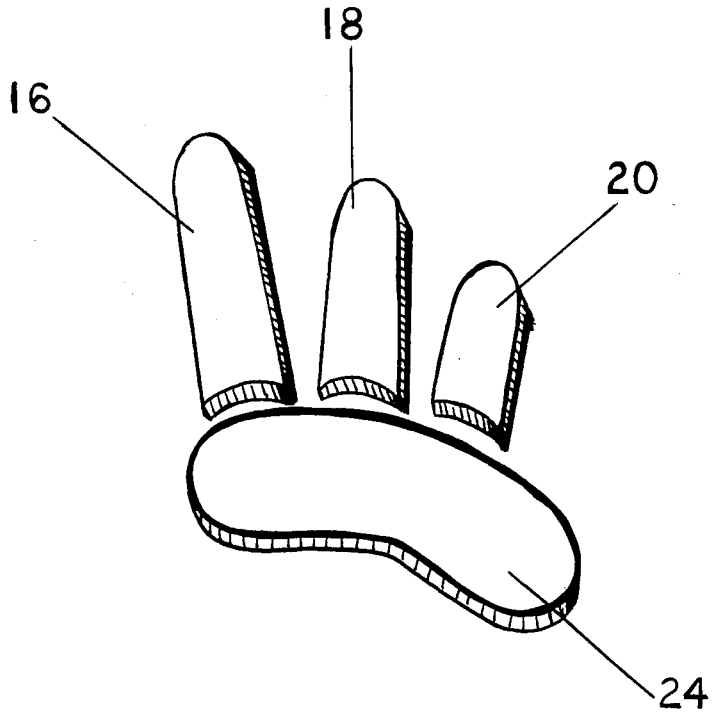
FIG. 2 a view of the embodiment of FIG. 1 depicting only the glove cushions.

Referring to FIGS. 1, 2, 3, 4 and 5, of the drawings, there is shown a protective inner glove embodying the features of this invention. This protective glove 12 consists of a tight-fitting, thin, flexible leather glove 14 with non-springy glove cushions 16, 18, 20, 22, 24, 26, 28, and 30 located over critical areas of the hand 32, 34, 36, 38, 40, 42, 44, and 46.

The critical areas to be protected during catching are: (1) the inside of the fingers 32, 34, 36, and 38 (second through fourth digits 52, 54, 56, and 58); and, (2) the upper palm finger pads 42.

Optional areas of protection are the inside 40 of the first digit (thumb 60), the inside 38 of fifth digit 58, and the palm areas 44 and 46. The palm area 44 begins from the outer edge of the palm extending inward and upward toward the bottom of the upper palm finger pads cushion. The palm area 46 covers the first digit pad and inner palm below the first digit 60.

Figure 3:
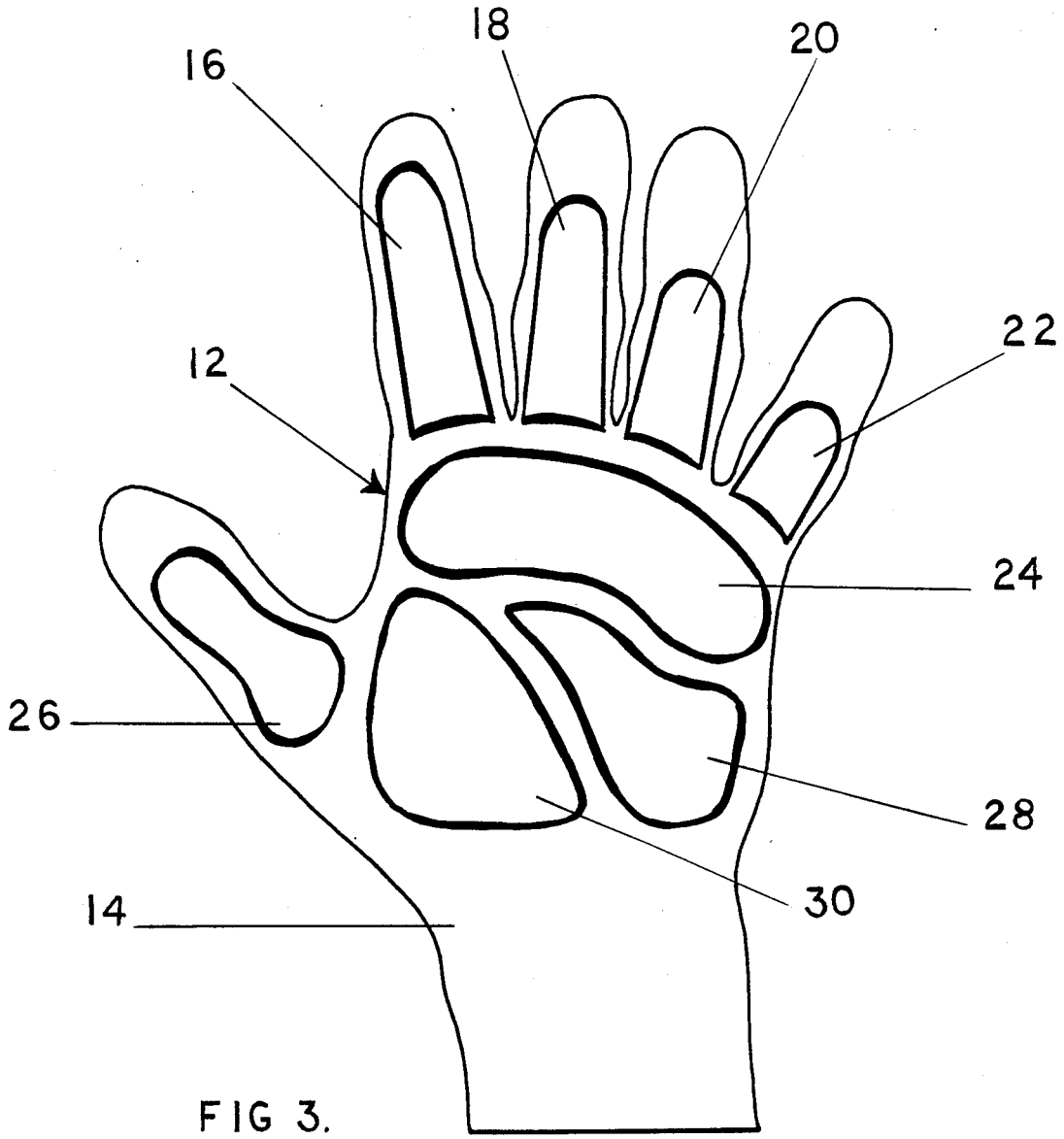
FIG. 3 is an inner hand view of the embodiment of the left hand protective inner athletic glove showing all possible locations the glove cushions.
Figure 4:
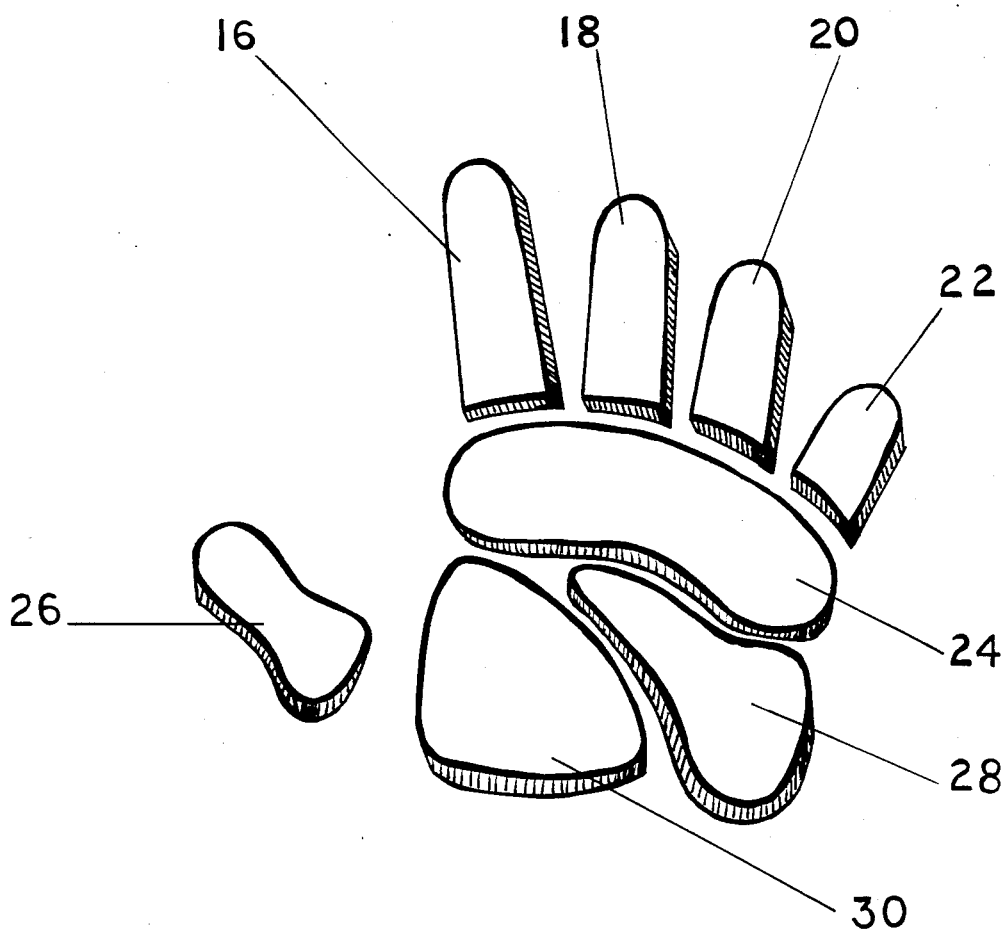
FIG. 4 is a view of the embodiment of FIG. 3 depicting only the glove cushions.
Figure 5:
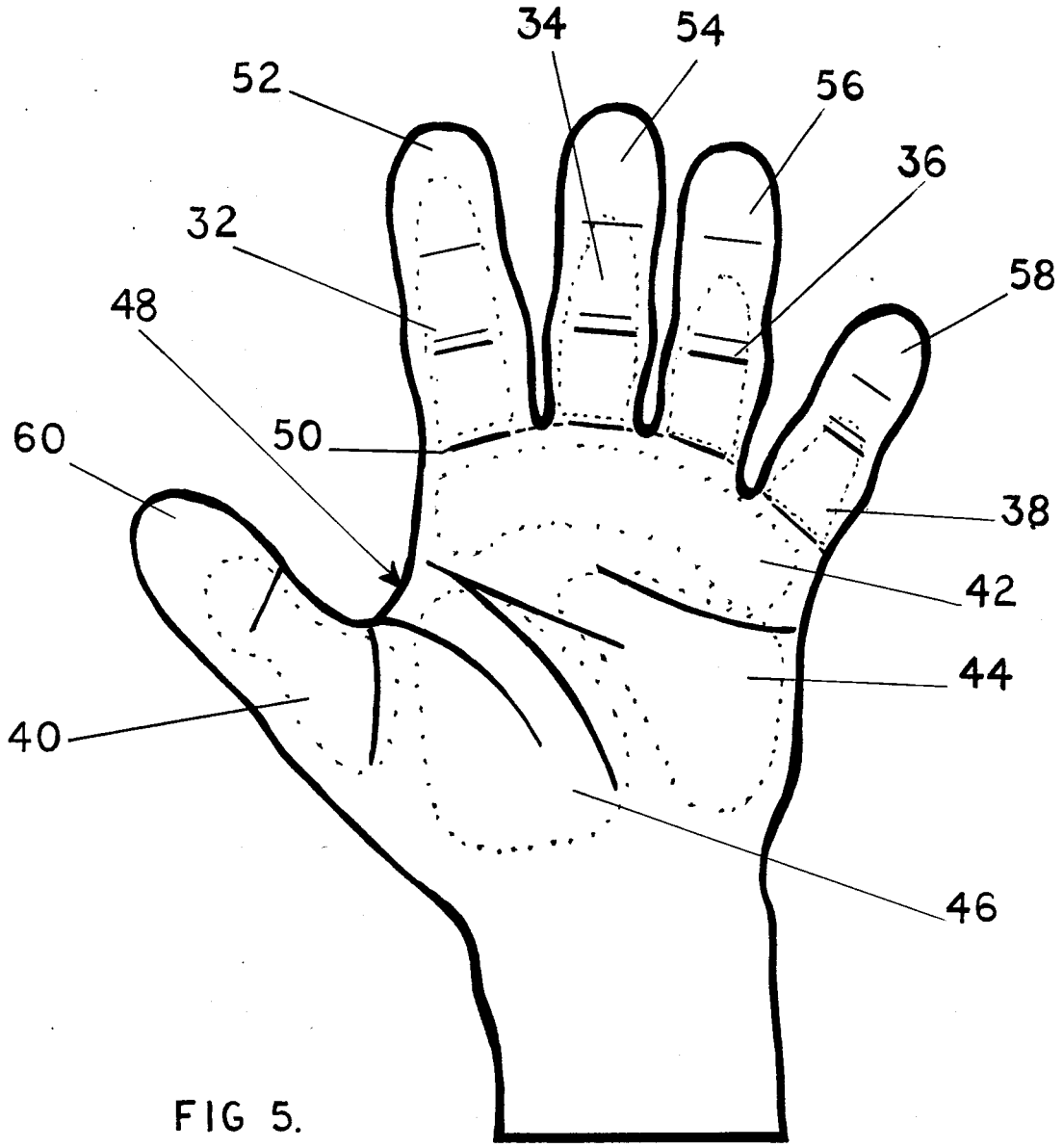
FIG. 5 is an inner hand view of a typical left hand.

Referring to FIGS. 3 and 5 the shock absorbing, non-springy cushion 16 for the second digit 52 begins just above the bottom of this digit, above the crease line 50 created at the point where the finger joins the palm, and extends upwardly beyond the second joint approximately midway between the second joint and the end of the second digit 52.

For the third digit 54, the shock absorbing, non-springy cushion 18 begins just above the bottom of the third digit 54, above the crease line 50, and extends upwardly to the second joint where it ends.

For the fourth digit 56, the shock absorbing, non-springy cushion 20 also begins just above the bottom of the digit, above the crease line 50, and extends beyond the first joint approximately midway between the first and second joint.

For the fifth digit 58 (pinky), the shock absorbing, non-springy cushion 22 again begins just above the bottom of the fifth digit, above the crease line 50, and extends just beyond the first joint where it ends.

Each finger cushion 16, 18, 20, and 22 is centered over an imaginary center line of the inside of each and extends outward on both sides from this center line towards the outer edges of that digit.

For the first digit 60 (thumb), the shock absorbing, non-springy cushion 26 begins just above the bottom of the digit, above the crease line created at the point where the thumb joins the palm, and extends beyond the first joint approximately midway between the first joint and the end of the thumb.

The thumb cushion 26 is set off center of an imaginary center line of the inside of the thumb 60 with two thirds of the thumb cushion 26 located on the outer side of the imaginary center line towards the outside of the hand.

All of the cushions are affixed to the leather glove and then covered with another layer of leather.

Figure 6:
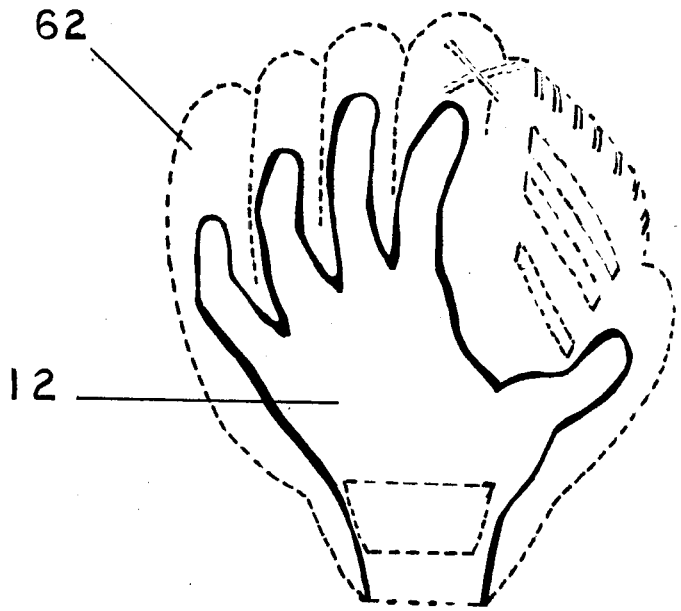
FIG. 6 is a outer hand view of the embodiment of FIG. 1 showing the actual use of a left hand protective inner glove inside a larger baseball or softball glove.
Figure 7:
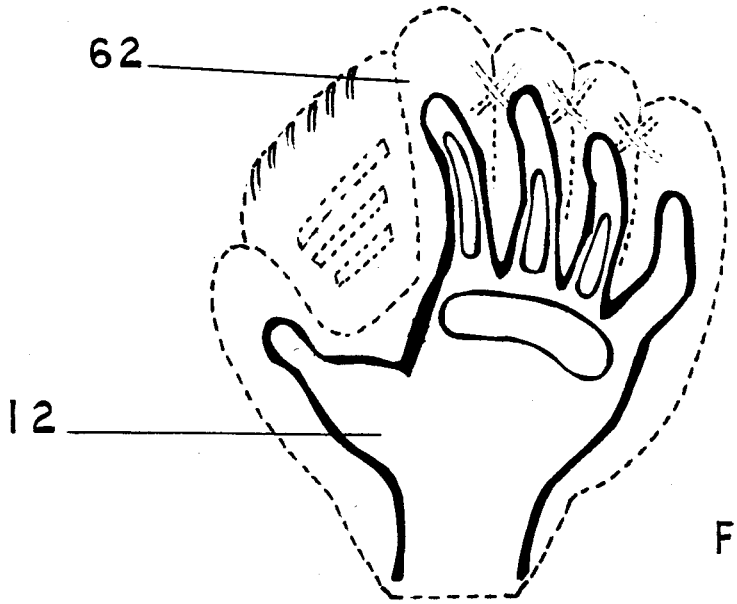
FIG. 7 is an inner hand view of the embodiment of FIG. 1 showing the actual use of a left hand protective inner glove inside a larger baseball or softball glove.

FIGS. 6 and 7 show a protective inner athletic glove in use. The protective inner athletic glove 12 fits inside a larger baseball or softball glove 62. The non-springy, shock absorbing cushions of the protective inner athletic glove 12 enhance the utilization of the outer glove because the cushions act in concert with the outer glove permitting mobility of the hand, with protection in critical areas, without propelling the ball away from the hand on impact.

The table below illustrates typical dimensions for the various shock absorbing cushions.

| Cushion Designation (Number) | Length (inches) | Width (inches) | Thickness (inches) |
|---|---|---|---|
| 16 | 2.25 | .5 | .1875 |
| 18 | 1.75 | .5 | .1875 |
| 20 | 1.5 | .5 | .1875 |
| 22 | 1 | .5 | .1875 |
| 24 | 3 | 1.0 | .25 |
| 26 | 1.25 | .5 | .1875 |
| 28 | 2.5 | 1.5 | .1875 |

-continued

| Cushion Designation (Number) | Length (inches) | Width (inches) | Thickness (inches) |
|---|---|---|---|
| 30 | 2.5 | 2.0 | .1875 |

What is claimed is:

1. A protective inner athletic glove for use in conjunction with a larger, outer baseball or softball glove for catching small, hard balls, comprising an inner glove and a non-springy, shock absorbing padding attached and covering portions of the palm and inner digits of said inner glove, with said inner digits being numbered first, second, third, fourth and fifth digits, the covering portions of said inner digits of said inner glove beginning above respective crease lines thereof where the digits join the palm and extending upward, without covering said respective crease lines or inner tips of the digits.

2. A protective inner athletic glove as recited in claim 1, wherein said glove consists of a thin layer of skin tight soft leather.

3. A protective inner athletic glove as recited in claim 1, wherein said non-springy, shock absorbing padding on the said second digit of said inner glove begins above the crease line created at the point where the finger joins the palm, and extends upwardly to a first point near the end of said second digit of said inner glove.

4. A protective inner athletic glove as recited in claim 3, wherein said non-springy, shock absorbing padding on said third digit of said inner glove extends from just above the base of said third digit of said inner glove and extends upward to a second point below said first point so that the padding of said third digit is shorter than the padding of said second digit.

5. A protective inner athletic glove as recited in claim 4, wherein said non-springy, shock absorbing padding on said fourth digit of said inner glove extends from just above the base of said fourth digit of said inner glove and extends upward to a third point below said second point so that the padding of said fourth digit is shorter than the padding of said third digit.

6. A protective inner athletic glove as recited in claim 5, wherein said non-springy, shock absorbing padding on said fifth digit of said inner glove extends from just above the base of said fifth digit of said inner glove and extends upward to a fourth point below said third point so that the padding of said fifth digit is shorter than the padding of said fourth digit.

7. A protective inner athletic glove as recited in claim 1, wherein said non-springy, shock absorbin padding on the second, third, fourth and fifth digits is centered over an imaginary center line on the inside of each of these respective digits of said inner glove and extends outward on both sides from this center line towards the outer edges of the respective digit.

8. A protective inner athletic glove as recited in claim 1, wherein said non-springy, shock absorbing padding on on said first digit of said inner glove is set off center of an imaginary center line on the inside of said first digit of said inner glove with two thirds of said cushion located on the outer side of the imaginary center line towards the outside of the hand.

9. A protective inner athletic glove as recited in claim 1, wherein said non-springy, shock absorbing padding is covered with a thin piece of leather.

10. A protective inner athletic glove as recited in claim 1, wherein said non-springy, shock absorbing padding is comprised of a non-resilient, open cell, ethyl vinyl acetate.

11. A protective inner athletic glove as recited in claim 1, wherein said non-springy, shock absorbing padding is between 3/16 and ¼ inch thick.

12. A protective inner athletic glove as recited in claim 1, wherein said non-springy, shock absorbing padding is located on the inner side of the second, third, and fourth digits of said inner glove and on an upper palm portion thereof.

13. A protective inner athletic glove as recited in claim 1, wherein said non-springy, shock absorbing padding is located on the inner side of the second, third, fourth, and fifth digits of said inner glove and on an upper palm portion thereof.

14. A protective inner athletic glove as recited in claim 1, wherein said non-springy, shock absorbing padding is located on the inner side of each digit of said inner glove and on an upper palm portion thereof.

15. A protective inner athletic glove as recited in claim 1, wherein said non-springy, shock absorbing padding is located on the inner side of each digit of said inner glove, on an upper palm portion thereof and on an outer palm portion thereof.

16. A protective inner athletic glove as recited in claim 1, wherein said non-springy, shock absorbing padding is located on the inner side of each digit of said inner glove, on an inner palm portion of said inner glove below the thumb portion thereof and on an upper palm portion thereof.

17. A protective inner athletic glove as recited in claim 1, wherein said non-springy, shock absorbing padding is located on the inner side of each digit of said inner glove on an upper palm portion thereof, on an inner palm portion below a thumb portion thereof and on an outer palm portion thereof.

18. A protective inner athletic glove as recited in claim 1, wherein said non-springy, shock absorbing padding is located on the inner side of the second and third digits and on an upper palm portion thereof.

19. A protective inner athletic glove as recited in claim 1, wherein said non-springy, shock absorbing padding is located on the inner side of the second digit and on an upper palm portion thereof.

* * * * *